US007023539B2

(12) United States Patent
Kowalski

(10) Patent No.: US 7,023,539 B2
(45) Date of Patent: Apr. 4, 2006

(54) DEVICE FOR MONITORING THE CONDITION OF THE SUPERSTRUCTURE ESPECIALLY OF FIXED RAILROAD TRACKS

(75) Inventor: Martin Kowalski, Nuremberg (DE)

(73) Assignee: Pfleiderer Infrastrukturtechnik GmbH & Co. KG, Neumarkt (DE)

( * ) Notice: Subject to any disclaimer, the term of this patent is extended or adjusted under 35 U.S.C. 154(b) by 364 days.

(21) Appl. No.: 10/626,405

(22) Filed: Jul. 24, 2003

(65) Prior Publication Data

US 2004/0117075 A1 Jun. 17, 2004

(30) Foreign Application Priority Data

Aug. 3, 2002 (DE) ..... 102 35 537

(51) Int. Cl.
*E01B 35/00* (2006.01)

(52) U.S. Cl. ..... 356/237.1; 33/287

(58) Field of Classification Search ..... 356/614, 356/623, 625, 237.12; 250/559.29, 559.31; 33/287

See application file for complete search history.

(56) References Cited

U.S. PATENT DOCUMENTS

| | | | | |
|---|---|---|---|---|
| 3,828,440 | A * | 8/1974 | Plasser et al. | 33/287 |
| 4,040,738 | A * | 8/1977 | Wagner | 33/287 |
| 5,786,750 | A * | 7/1998 | Cooper | 340/425.5 |
| 6,119,353 | A * | 9/2000 | Grønskov | 33/287 |

FOREIGN PATENT DOCUMENTS

WO WO 96/31655 10/1996

* cited by examiner

*Primary Examiner*—Richard A. Rosenberger

(74) *Attorney, Agent, or Firm*—Jordan and Hamburg LLP

(57) ABSTRACT

A device for monitoring the superstructure state especially of fixed railroad tracks, with a height sensor system, which is installed in a measuring vehicle, preferably constructed as a laser scanning system, for determining the height position of an anchor clamp and/or of the base of a rail and/or of a railroad tie.

3 Claims, 1 Drawing Sheet

DEVICE FOR MONITORING THE CONDITION OF THE SUPERSTRUCTURE ESPECIALLY OF FIXED RAILROAD TRACKS

BACKGROUND OF THE INVENTION

Due to material fatigue, material breakage or other aging processes, a plurality of changes in the foundation of the fixed railroad track may occur and, as far as possible, should be monitored constantly and, if necessary, corrected.

SUMMARY OF THE INVENTION

In order to be able to carry out such monitoring as simply as possible and at regular intervals, a device is provided pursuant to the invention, which is characterized by a height sensor system, which is installed in a measuring vehicle and preferably constructed as a laser scanning system, for determining the height position of an anchor clamp and/or of the base of the rail and/or of a railroad tie.

Such a sensor monitoring system is configured most easily for detecting loosened anchor clamps. In a further development of the invention, provisions are made for this purpose so that the height-scanning system, disposed above the central loop of the anchor clamps, detects the difference in height between the central loop and the surface of the angle guiding plate, which can be achieved in the simplest case with one and the same height-scanning sensor. If the locking screw is loose, the central loop of the anchor clamp springs upwards, so that, during the scanning height of this central loop, there is an appreciable deviation in height from the nominal value, which enables such a loosened anchor clamp to be detected rapidly and reliably.

In order to monitor the rigidity of the elastic intermediate layer of the rail support or to detect loosened railroad ties, a device is provided pursuant to the invention, for which the height-scanning system has two scanning sensors, which are disposed next to one another in the region of a an axle, which is under load, and an axle, which is not under load, of the measuring vehicle. In order to monitor the rigidity of the elastic intermediate layers of the rail support, one of these scanning sensors of each scanning sensor pair, disposed at separate axles, detects the base of the rail and the other detects the surface of the railroad tie. In each case, the difference in the height values, measured by each sensor pair, is determined, the difference for the axial under load obviously being greater than the difference for the axles not under load. The magnitude of this deviation is a measure of the still existing rigidity of the elastic intermediate layers.

In order to detect loosened railroad ties, the sensors of each sensor pair of an axle detect once the surface of the railroad tie and once the surface of the concrete supporting plate. In contrast to fixed railroad ties, the height of the surface of a loosened (and, with that, a moving) railroad tie above the concrete supporting plate varies, so that here also once again such loosened railroad ties can be detected easily merely by driving over a segment with a measuring vehicle.

Further advantages, distinguishing features and details of the invention arise out of the following description of an example of an embodiment, as well as from the accompanying drawings.

DESCRIPTION OF THE PREFERRED EMBODIMENTS

Figure 1:
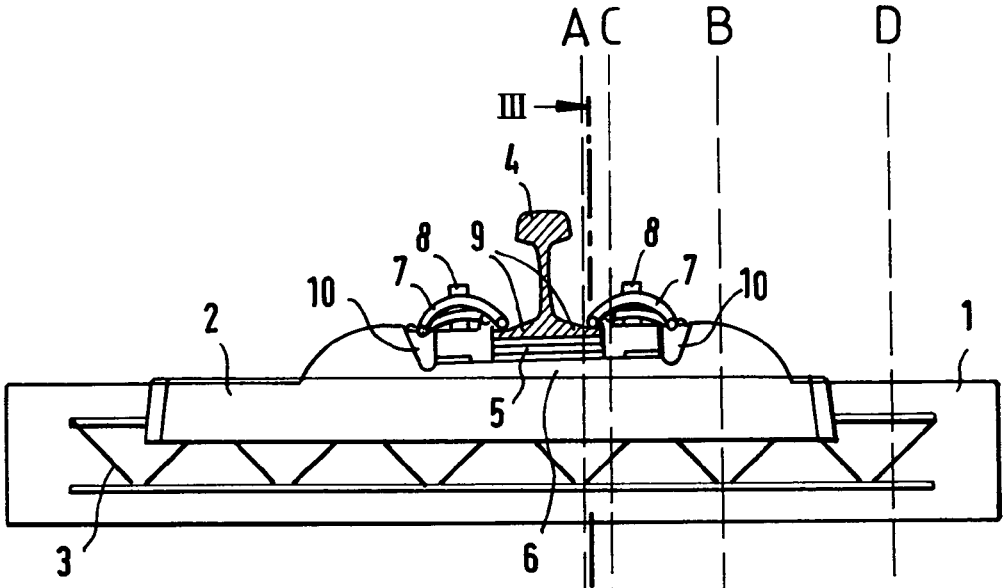
FIG. 1 shows a partial cross section through a fixed railroad track parallel to the axis of the railroad ties.
Figure 2:
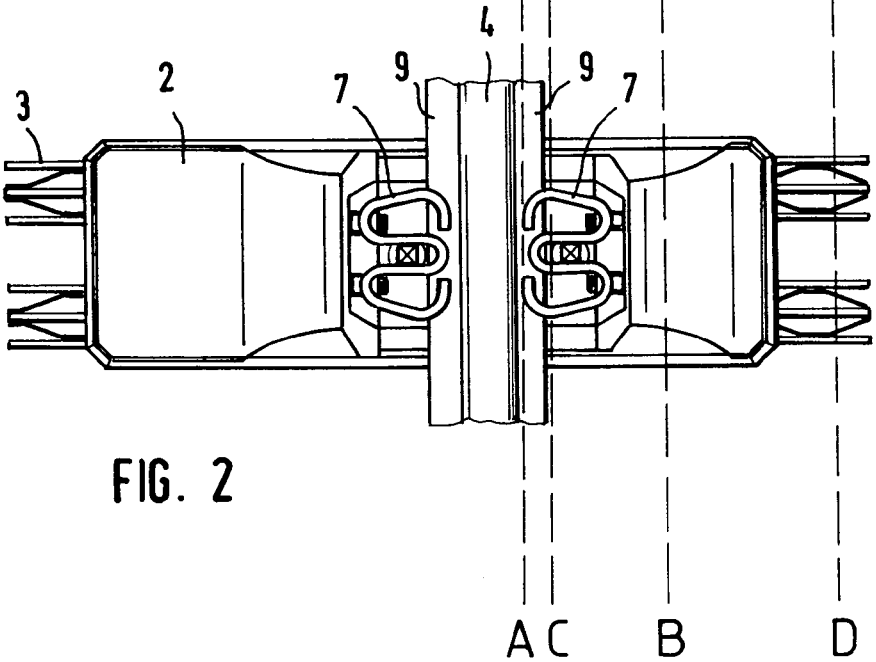
FIG. 2 shows a plan view of the railroad tie section of FIG. 1, the different scanning lines being drawn, along which height-measuring sensors at a measuring carriage can be moved.
Figure 3:
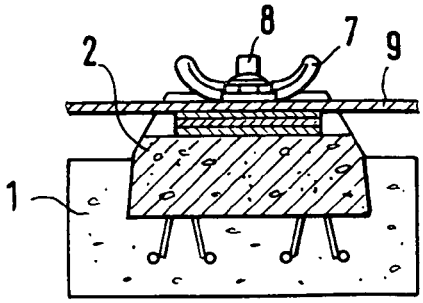
FIG. 3 shows a section along the line III—III of FIG. 1.

The railroad ties (in the present case, one half 2 of a two-block railroad tie with protruding lattice support reinforcement 3) is cemented into a fixed railroad track plate, the rail 4 being mounted on the rail support 6 over intermediate layers 5 and held by means of railroad tie clips 7 and locking screws 8, which pass through these railroad tie clips 7. The anchor clamp 7 is supported, on the one hand, on the base 9 of the rail and, on the other, on the angle guiding plates 10. In order to monitor the rigidity of the elastic intermediate layers 5, height-scanning sensors, preferably a laser scanning system, extend along the line A—A as well as along the line B—B. In each case, two adjacent height-scanning sensors are provided at an axle, which is under load, and at an axle, which is not under load, of a measuring vehicle, so that the one runs along the line A and the other along the line B. The sensor at the axle, which is under load, provides values for determining the surface height of the base 7 of the rail under load, relative to the height position of the surface of the railroad tie, unchanged by the load, along the line B—B.

The second pair of sensors at an axle, which is not under load, once again determines the distance between the base 7 of the rail and the surface of the railroad tie and, from this, especially the difference between these height values, since this difference is different for axles, which are under a load, then for axles, for which the intermediate layers 5 are not compressed as much. This difference provides a measure of the compressibility of the intermediate layers, from which the rigidity can be determined and monitored.

In order to detect loosened anchor clamps, a height-scanning sensor runs along the scanning line C—C, determining, on the one hand, the height of the surface of the anchor clamp, especially of the center loop of the anchor clamp, relative to the height of the surface of the angle guiding plate 10. If the locking screw 8 has become loose, the center loop springs upwards, so that the distance from the angle guiding plate is much larger. This can be recognized by a corresponding change in the difference between the scanned height values of the anchor clamp and the angle guiding plate. In this case, the measurement range should be about 30 mm and the resolution 0.2 mm or better. In the case of this detection of loosened anchor clamps, it is generally not necessary to differentiate between axles under load and axles not under load.

For detecting loosened railroad ties, a scanning device is used, which is similar to that already used to monitor the rigidity of the elastic intermediate layers. In this case, however, the scanning sensors run along the line B on the one hand and along the line D on the other. By pressing down the loosened railroad tie into the railroad track plate 1, the sensors at the axle, which is under load, determine a lesser height difference between the surface of the railroad tie and in the surface of the railroad track plate than do the sensors at the railroad tie, which is not under load. At the railroad tie, which is not under load, the loosened railroad tie protrudes more from the railroad track plate 1, so that the corresponding height differences are greater. The measurement range in this case should be about 100 mm and the resolution once again about 0.2 mm.

What I claim is:

1. A device for monitoring the superstructure state of fixed railroad tracks, comprising a height sensor system constructed as a laser scanning system installed in a measuring vehicle and used for detecting loosened locking screws, the height sensor system being disposed over a center loop of an anchor clamp and determines the difference in height between the center loop and a surface of an angle guiding plate.

2. A device for monitoring the superstructure state of fixed railroad tracks, comprising a height sensor system constructed as a laser scanning system installed in a measuring vehicle and used for detecting the rigidity of elastic intermediate layers of a rail support whereby in the region of an axle which is under load, and an axle which is not under load, the height sensor system in each case has two scanning sensors, which are disposed next to one another and one of which scans a base of a rail and another the surface of a railroad tie.

3. A device for monitoring the superstructure state of fixed railroad tracks, comprising a height sensor system constructed as a laser scanning system installed in a measuring vehicle and used for detecting loosened railroad ties, whereby in the region of an axle which is under load, and an axle which is not under load, the height sensor system in each case has two scanning sensors, which are disposed next to one another and of which one scans the surface of the railroad tie and the other the surface of a concrete supporting plate.

* * * * *